US006047406A

United States Patent [19]

Dicker et al.

[11] Patent Number: 6,047,406

[45] Date of Patent: Apr. 11, 2000

[54] ENERGY EXPENDITURE GARMENT

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 09/373,520

[22] Filed: Aug. 13, 1999

Related U.S. Application Data

[63] Continuation-in-part of application No. 09/151,840, Sep. 11, 1998, Pat. No. 5,978,966.

[51] Int. Cl.[7] ..... A41B 1/00

[52] U.S. Cl. ..... 2/69; 2/227; 2/228; 2/115; 482/120; 450/104

[58] Field of Search ..... 2/69, 79, 228, 2/227, 238, 170, 108, 115, 102, 70, 455, 456; 482/105, 124, 120, 121, 131, 74; 450/104

[56] References Cited

U.S. PATENT DOCUMENTS 4,625,336 12/1986 Derderian ..... 2/79
4,670,913 6/1987 Morell et al. ..... 2/227
4,698,847 10/1987 Yoshihara ..... 2/69
5,109,546 5/1992 Dicker ..... 2/70
5,201,074 4/1993 Dicker ..... 2/70
5,282,277 2/1994 Onozawa ..... 2/69
5,367,708 11/1994 Fujimoto ..... 2/69
5,737,772 4/1998 Dicker et al. ..... 2/69
5,737,773 4/1998 Dicker et al. ..... 2/69
5,819,322 10/1998 Dicker et al. ..... 2/456
5,978,966 11/1999 Dicker et al. ..... 2/69

*Primary Examiner*—Gloria M. Hale
*Attorney, Agent, or Firm*—Connlly Bose

[57] ABSTRACT

An energy expenditure garment is made of a variable density fabric having a plurality of zones of differing resistance characteristics. This is accomplished by utilizing threads in the fabric of differing resistance characteristics so that the zones are seamless and blend into each other.

23 Claims, 3 Drawing Sheets

ENERGY EXPENDITURE GARMENT

CROSS REFERENCE TO RELATED APPLICATION

This application is a continuation in part of application Ser. No. 09/151,840 filed Sep. 11, 1998 now Pat. No. 5,978,966.

BACKGROUND OF THE INVENTION

Various garments have been suggested which involved elastic elements to provide a resistance to an activity which would require the swinging or bending of the arms and/or legs and/or body. Generally, such elastic elements are elastic cords or bands which are separate from the remainder of the garment, but otherwise are attached to the garment or the elastic elements are in the form of elastic panels which are integral with the remainder of the garment.

U.S. Pat. Nos. 5,700,231 and 5,824,959 disclose in FIGS. 7–9 of each patent an embodiment where an elongated elastic element or cord is sewn directly into the fabric. The cord can thereby provide more tension and give the garment greater resistance. The cord can be attached to the outside of the fabric on the fabric or can be sewn in the fabric. The cord can be sewn throughout the whole suit or can be located in specific locations that the user wants to create greater resistance, such as in the chest, or the legs, or shoulders, or back, etc. Both patents illustrate a woven fabric strand woven around the elastic cord thereby forming a suit having a greater elasticity in the regions where the elastic cords are placed. The patents point out that it is possible instead of having an elastic cord that a material of different material intensity can be sewn into the suit which is by a continuous weave/variable density strips. Both patents also illustrate an upper portion of an exercise garment having panels which can be inserted on the garment, or can be sewn into the garment. The panels can provide greater resistance by being more elastic. The panels can have an elastic cord woven into the fabric. In addition, the panels can be continuous woven/variable density strips.

Parent application Ser. No. 09/151,840 filed Sep. 11, 1998, discloses energy expenditure or exercise garments which have different zones of elastic resistance. That application also discloses the incorporation of a lattice type structure in the garment so that when there is a longitudinal pulling of the garment during an exercise the longitudinal pulling creates an increased compression effect to tighten the ring formed by the lattice structure, similar to finger cots where a pulling causes the material to tighten.

SUMMARY OF THE INVENTION

An object of this invention is to provide an energy expenditure garment which has a plurality of zones of differing resistance characteristics.

In accordance with the invention the zones are seamless and blend into each other. In a preferred practice of the invention the fabric used for making the body portion of the garment is a variable density fabric and the zones are adjacent to each other.

The invention may be practiced by incorporating a lattice weave as the anchor structure for at least one of the zones located on a limb portion of the garment.

The invention may also be practiced where the garment includes a shirt portion and a pants portion with the shirt portion having zones of lesser resistance than the pants portion.

DETAILED DESCRIPTION

The present invention relates to variations in features shown and described in parent application Ser. No. 09/151,840, all of the details of which are incorporated herein by reference thereto.

One of the general approaches previously taken for energy expenditure garments is to utilize resistance elements or structures, such as cords or bands which are readily visible. For example, use might be made of the wide bands as part of the aesthetic appearance of the garment by having the bands of a different color than the remaining fabric. Where the bands are sewn to the fabric the outer edges of the bands provide a clear visual line of distinction of a band with its adjacent fabric. There are times, however, where it might be desirable to have the bands of a more subtle nature which blends into its adjacent fabric so that to the naked eye the bands are not visible. The present invention is directed to such variations where a garment includes a plurality of zones having different resistance characteristics. This is accomplished by utilizing a variable density fabric for making the garment. Such variable resistance fabric permits the zones to be seamless and to blend into each other.

Each of the inventors, both singly and jointly, have various patents relating to energy expenditure or aerobic resistance garments. These patents show various techniques for providing resistance at different locations of the garment and show variations in the garments themselves with regard to incorporation of such structure as suspenders, variable neck openings, relative length of the arms and legs and locations for the resistance structure. These patents may be referred to for such features. Accordingly, the details of the patents by both inventors, singly and jointly, are incorporated herein by reference thereto. Parent application Ser. No. 09/151,840 is particularly referred to with regard to features which may be incorporated as part of the invention.

Figure 1:
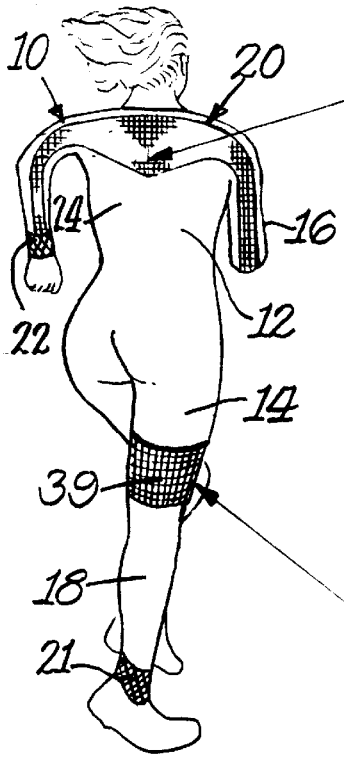
FIG. 1 is a perspective view showing an energy expenditure garment in accordance with this invention.

FIG. 1 illustrates a garment 10 in accordance with this invention. As shown therein, garment 10 is a full body garment having an upper portion 12 and a lower portion 14. Portion 12 may be considered a shirt having arms 16, while lower portion 14 may be considered pants having legs 18. As illustrated a resistive loading fabric 20 extends across the back of the garment and down the arms and terminates in anchor structure 22. The size and location of this fabric 20 is merely for illustrative purposes. Other sizes and locations may be used as described in the earlier patents of the inventors. It is also to be understood that while FIG. 1 illustrates the fabric 20 to be distinct from the adjacent base fabric 24, in the actual practice of the invention all of the fabric would be made of variable density material wherein zones would be created having differing resistance characteristics in the sense that a different amount of resistance force is encountered from one zone to another when the wearer of the garment moves to stretch the variable resistance fabric and in resisting the fabric returning to its unstretched condition. Because the zones are created by using a variable density fabric the transition from one zone to another is accomplished without having separate and distinct resistance bands, for example, which would be sewn to the base fabric. In other words, the transition from one zone to another takes place by changing the characteristics in the adjacent zones so that the zones are seamless with respect to each other and blend into each other. Accordingly, it is to be understood that where the various figures show a particular zone visually distinct from its adjacent material, this visual distinctness is for illustrative purposes to show the location of a zone. In actual use, however, the adjacent zones would blend into each other because of the seamless nature achieved through the use of variable density fabric.

Figure 2:
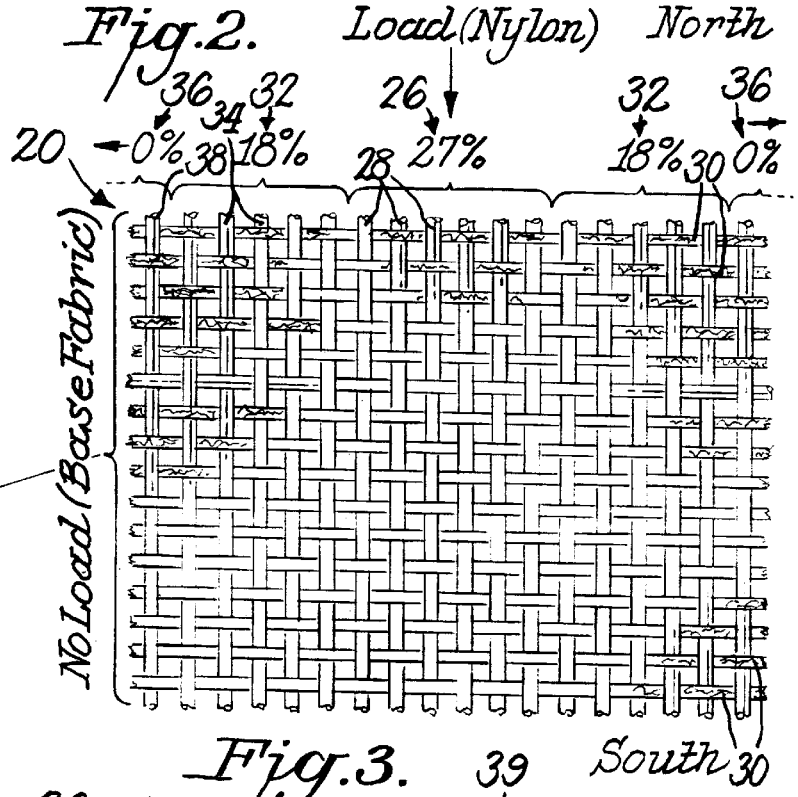
FIG. 2 is an enlarged fragmental view showing the resistance weave characteristics in one portion of the garment of FIG. 1 as indicated by the arrow.

FIG. 2 illustrates the variable density fabric 20 such as might be incorporated for the resistive loading area in the general portion of the garment indicated by the reference numeral 20 in FIG. 1. As shown therein the fabric 20 includes a central zone 26 having relatively high resistance characteristics which is achieved by incorporating material such as 27% nylon for the strands or threads 28 in the warp direction. The strands or threads 30 in the weft direction would be made of a material such a cotton fibers having lesser stretch characteristics than the weft thread 28. Thus, in the central zone 26 the use of material such as 27% nylon/LYCRA provides a zone with relatively high resistance characteristics. On each side of zone 26 is a zone 32 which incorporates thread 34 made of, for example, 18% nylon/LYCRA so as to have slightly lesser characteristics than the central zone 26. Finally, adjacent to each intermediate zone 32 is a zone 36 having threads 38 containing no resistance material such as nylon/LYCRA. In this manner, the segment of fabric shown in FIG. 2 thereby includes five zones where each zone is adjacent to another zone having differing resistance characteristics. Since it is simply the warp threads which affect the resistance characteristics, the transition from one zone to another takes place without any visual distinction since the zones are seamless and blend into each other.

The invention may also be practiced where it is the weft threads which have different resistance characteristics.

Figure 3:
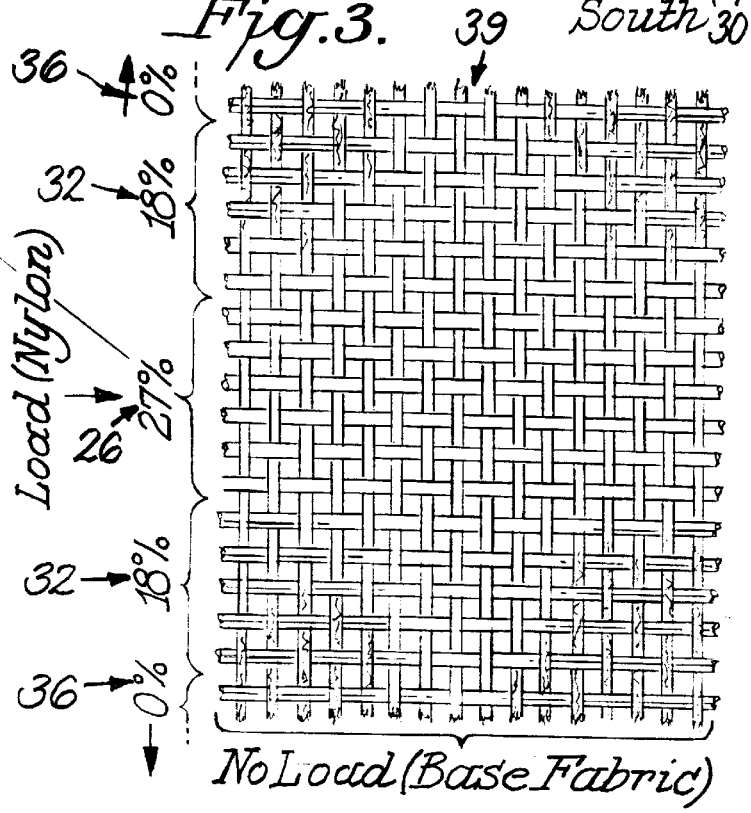
FIG. 3 is an enlarged fragmental view showing the resistance weave characteristics in another portion of the garment of FIG. 1 as indicated by the arrow.

FIG. 3 illustrates a fabric formed as a ring 39 in the garment 10. As shown therein, the fabric includes a plurality of zones 26, 32,32 and 36,36, similar to the fabric 20. Garment 10 may include as its base material fabric 24 having the characteristics of zone 36 where both the weft threads and the warp threads incorporate very little or no nylon/LYCRA.

In the preferred practice of the invention there is a gradual increase/decrease in the resistance characteristics for sets of adjacent zones. It is to be understood that the variable density fabric may be made, in the broad practice of the invention, where there are only two zones. The invention may also be practiced where there are more than three different resistance characteristic zones, rather than the three types of zones illustrated in FIGS. 2–3. The invention may also be practiced where there are a plurality of adjacent zones which do not progressively increase/decrease in resistance characteristics. Thus, for example, a zone containing 27% nylon may be adjacent to a zone containing 18% nylon which in turn is adjacent to a zone containing 22% nylon.

Figure 4:
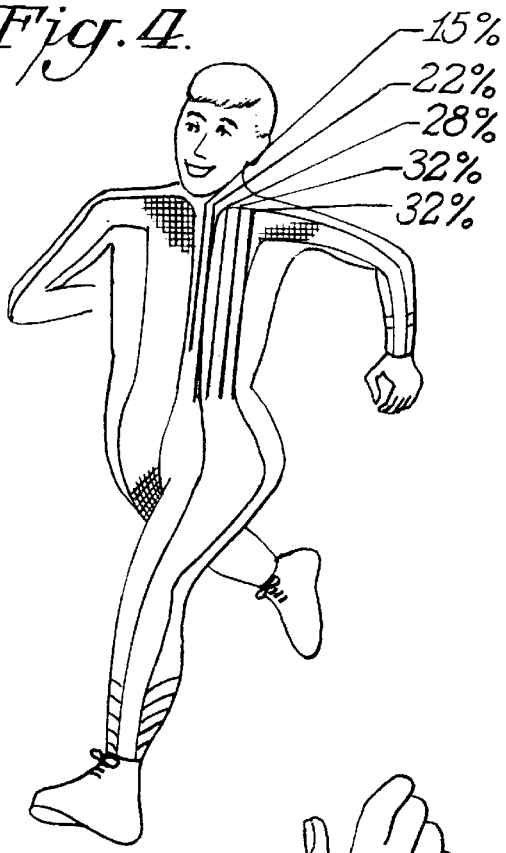
FIGS. 4–5 are perspective views showing alternative garments in accordance with this invention.

FIG. 4 illustrates a garment having longitudinal adjacent zones with differing resistance characteristics as indicated therein by the numerical percentages of nylon in the thread material.

Figure 5:
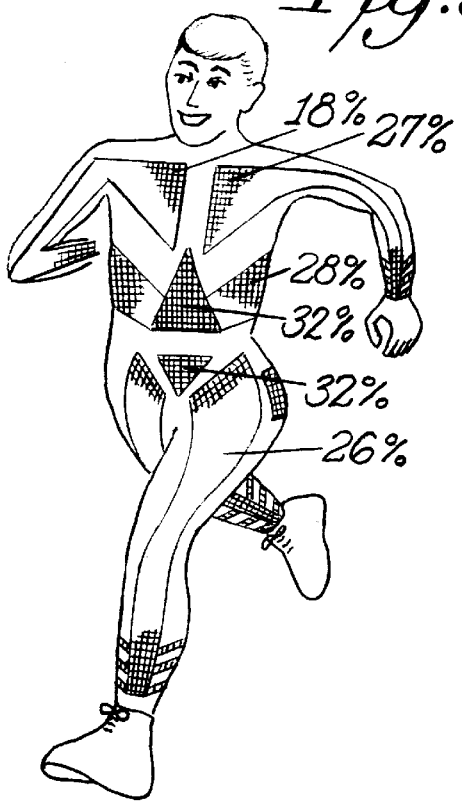

FIG. 5 illustrates a garment where the various zones take forms other than being generally longitudinal. Thus, for example, zones of differing shapes may be located in the garment adjacent to each other with differing resistance characteristics as indicated therein by the numerical percentages of the nylon material in the threads. Thus, a garment could be formed which is customized for the particular needs of an individual wearer or of groups of wearers. An example of such a customized garment might include zones which are oblique or at an angle rather than purely horizontal or purely vertical located in the abdominal area containing medium density nylon. A purely vertical or longitudinal zone might be located to provide abdominal muscle resistance where the zone incorporates medium outer fibers with high density inner fibers providing inferior to superior lines of force. The garment may also include a lower abdominal support/resistance zone having inner medium density nylon fibers with the lines of force being inferior to superior and having outer high density nylon percent fibers with the lines of force being oblique to the inner fibers. The same garment could include medium density inner anterior leg zones incorporating a muscle resistance weave for exercising such muscle groups as the quadriceps. The garment could include high density outer anterior leg/thigh zones coming from behind the leg for exercising various muscle groups. The garment could include a zone for the breast/pectoralis muscles which would include medium to high density percent fibers at an oblique direction to provide anterior/superior force lines for exercising the breast tissue thereby increasing the blood/oxygen flow decreasing the metabolytes increasing the lymph flow, increasing the tissue drain and decreasing the cystic change. The garment may include an upper body arm zone having high density nylon percent with horizontal force lines. As a result, by the use of different zones of resistance characteristics and by the orientation of the resistance threads, such as horizontal, vertical or oblique a customized garment could be performed for maximizing the energy expenditure or aerobic characteristics of the garment.

Figure 6:
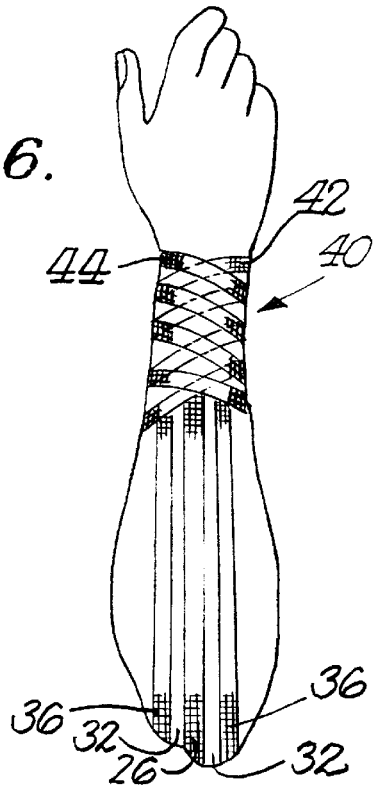
FIG. 6 is an elevational view showing the arm portion of a garment in accordance with this invention.

FIG. 6 illustrates a feature of the invention wherein various longitudinal or vertical oriented zones 26,32,36 blend into another portion of the garment used for anchoring the zones. The anchoring portion 40 is made of a lattice weave having inner medium density nylon threads 42 with oblique lines of force extending from a right to left direction. Outer medium density nylon threads 44 would have oblique lines of force extending from the left to the right direction. The anchoring portion 40 might be about 4–5 inches long. When there is a longitudinal pull from the resistance zones, such as 26,32 this longitudinal pull causes a tightening of the lattice weave to provide an anchor structure. It is to be understood that while FIG. 6 shows the lattice weave as an anchor structure on the hand in the wrist area, such anchor structure may also be included at other locations such as the ankle. FIG. 1, for example, illustrates wrist anchor structure 22 and ankle anchor structure 21 which could incorporate a lattice weave.

Anchor structure, such as the lattice weave, could be located at any suitable portion of the garment where such anchoring is desired. Examples of such anchor structure includes the waist, knees, elbows and neck portions.

In a preferred practice of the invention greater resistance material is used in the pants portion than in the shirt portion of the garment.

Figure 7:
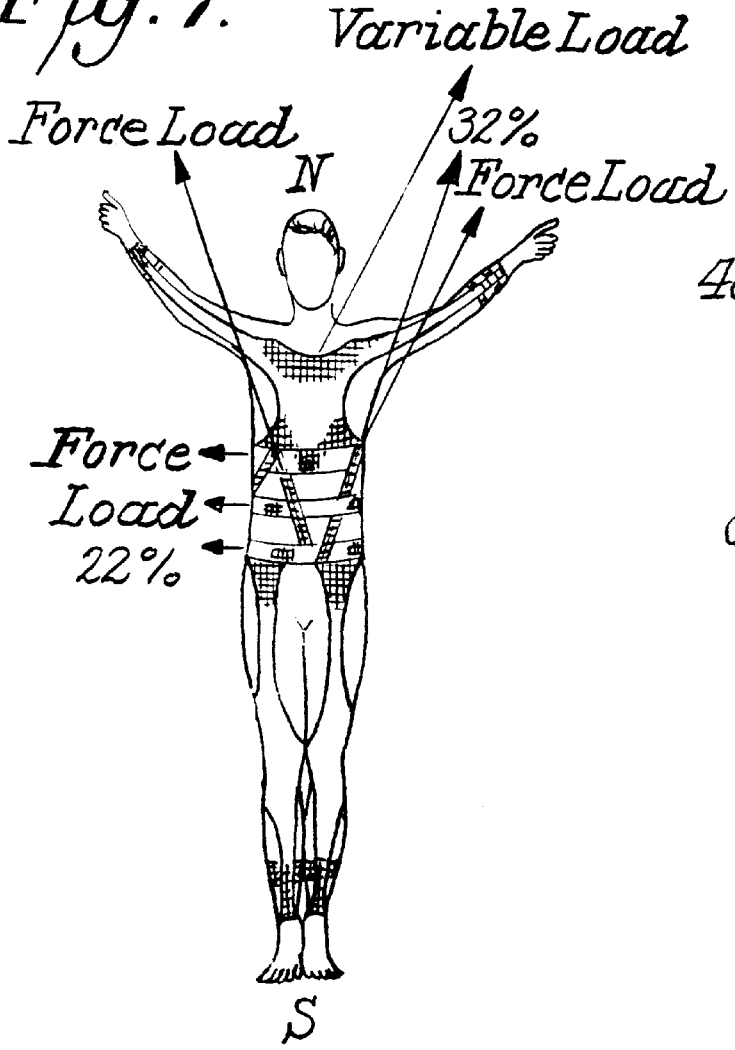
FIG. 7 is a schematic diagram showing the load force on a garment in accordance with this invention.

FIG. 7 shows the various force vectors resulting from use of a garment incorporating zones in various locations.

Figure 8:
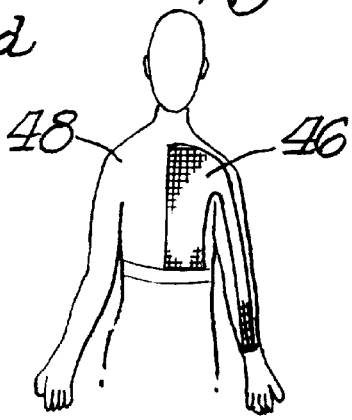
FIG. 8 is a schematic drawing showing an alternative form of garment in accordance with this invention.

FIG. 8 shows a variation of the invention wherein, for example, zones of greater resistance characteristics such as zone 46 would be located in a selected portion of the garment as compared to zones of lesser resistance characteristics such as zone 48. Such a garment might, for example, have the high resistance zone or zone 46 located on only one side of the garment where for various training and/or rehabilitation purposes a particular set of muscles or particular portion of the user should have greater resistance characteristics for developing that portion of the user's body.

Figure 9:
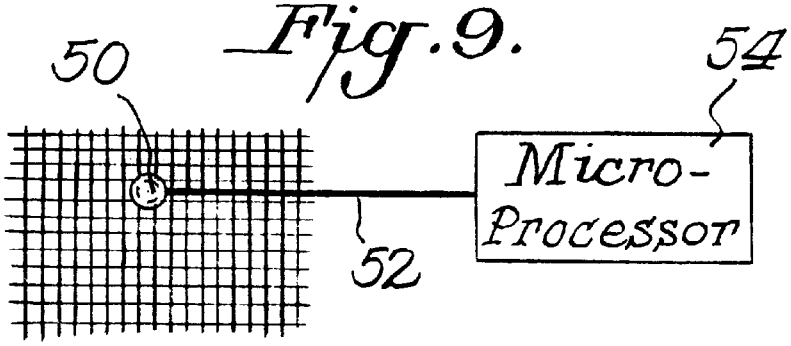
FIG. 9 is a schematic view of a portion of a garment in accordance with a further feature of this invention.

By using a variable density fabric which incorporates individual threads of particular resistance characteristics it is also possible to practice the invention where use is made of specific threads in the fabric. FIG. 9, for example, illustrates how such a fabric could be used for providing biofeedback information. It is known to incorporate fiber optics and electrically conductive thread into a garment for providing biofeedback information. FIG. 9 illustrates how such known techniques could be incorporated into an energy expenditure or aerobic resistance garment of this invention. As shown therein a sensor 50 would be in electrical communication with a selected thread or threads of the garment. The sensor would communicate by a conductor 52 to a microprocessor 54 which could be worn on the garment. The sensor would feed information to the microprocessor so as to provide data indicating blood pressure, pulse rate, heart EKG, etc. in a known manner.

It is to be understood that while particular reference has been made to nylon/LYCRA as resistance material for incorporation in the variable density fabric, other materials could be used having resistance characteristics such as a raschel/warp knit. The base fabric and weft threads could be made from cotton, polyester, rayon, or other materials. The listing of specific materials is thus solely for exemplary purposes.

As should be apparent the present invention provides for the ability to customize garments for individuals or groups of individuals having common exercise or conditioning needs. The invention also lends itself to varying the aesthetic appearance of the garment without being affected by the location of the different resistance zones because the resistance zones are not distinguishable from each other.

What is claimed is:

1. An energy expenditure garment comprising a body portion having outwardly extending limb portions, said body portion being made of a variable density fabric having a plurality of zones of differing resistance characteristics whereby a different amount of resistance force is encountered from one zone to another zone when a wearer of said garment moves to stretch said fabric and in resisting said fabric returning to its unstretched condition, and said zones being seamless and blending into each other.

2. The garment of claim 1 wherein said fabric is woven with threads having differing resistance characteristics in one zone as compared to an adjacent zone.

3. The garment of claim 2 wherein at least one of said zones extends longitudinally down one of said limb portions, anchor structure at the end of said limb portion, said at least one zone being anchored by said anchor structure, and said anchor structure being a lattice weave.

4. The garment of claim 2 wherein said body portion comprises a shirt and a pants, said limb portions comprising arms extending from said shirt and legs extending from said pants, and each of said shirt and said pants having said zones of differing resistance characteristics.

5. The garment of claim 4 wherein said zones are included in patches.

6. The garment of claim 4 wherein said body portion includes a right side and a left side, and said zone in one of said sides having greater resistance characteristics than said zone in the other of said sides.

7. The garment of claim 4 wherein said zone in said shirt has lesser resistance characteristics than said zone in said pants.

8. The garment of claim 4 wherein at least one of said zones has longitudinal resistance lines of force, and at least another of said zones has circular resistance lines of force.

9. The garment of claim 7 wherein said longitudinal lines of force include vertical and horizontal lines of forces for separate ones of said zones.

10. The garment of claim 9 wherein said longitudinal lines of force further include oblique lines of force for a further separate one of said zones.

11. The garment of claim 4 wherein at least one of said zones extends longitudinally down one of said limb portions, anchor structure at the end of said limb portion, said at least one zone being anchored by said anchor structure, and said anchor structure being a lattice weave.

12. The garment of claim 4 wherein at least one of said zones includes bio-feedback structure for monitoring biological functions of the wearer.

13. The garment of claim 4 wherein there are at least three of said zones having resistance characteristics which differ from each other.

14. The garment of claim 13 wherein said zones progressively increase/decrease in resistance characteristics for at least three adjacent zones.

15. The garment of claim 4 wherein at least one of said zones is triangularly shaped.

16. The garment of claim 2 wherein said fabric has warp direction threads and weft direction threads, said warp direction threads of greater stretch characteristics than said weft direction threads, and said warp direction threads having different resistance characteristics to create said zones.

17. The garment of claim 16 wherein adjacent sets of said warp direction threads progressively increase/decrease in resistance characteristics for at least three adjacent zones.

18. The garment of claim 1 wherein at least one of said zones extends longitudinally down one of said limb portions, anchor structure at the end of said limb portion, said at least one zone being anchored by said anchor structure, and said anchor structure being a lattice weave.

19. The garment of claim 1 wherein said body portion includes a right side and a left side, and said zone in one of said sides having greater resistance characteristics than said zone in the other of said sides.

20. The garment of claim 1 wherein at least one of said zones has longitudinal resistance lines of force, and at least another of said zones has circular resistance lines of force.

21. The garment of claim 20 wherein said longitudinal lines of force include vertical and horizontal lines of forces for separate ones of said zones.

22. The garment of claim 21 wherein said longitudinal lines of force further include oblique lines of force for a further separate one of said zones.

23. The garment of claim 1 wherein at least one of said zones includes bio-feedback structure for monitoring biological functions of the wearer.

* * * * *